US005195247A

United States Patent [19]

Wilcox

[11] Patent Number: 5,195,247

[45] Date of Patent: Mar. 23, 1993

[54] CONSTRUCTION LAYOUT MARKING DEVICE

[75] Inventor: Timothy A. Wilcox, Lawrenceville, Ga.

[73] Assignee: Bremer Systems, Inc., Lilburn, Ga.

[21] Appl. No.: 889,802

[22] Filed: May 29, 1992

[51] Int. Cl.[5] ..... B43L 13/00

[52] U.S. Cl. ..... 33/36; 33/41.3

[58] Field of Search ..... 33/41.3, 36, 37, 35

[56] References Cited

U.S. PATENT DOCUMENTS

| | | |
|---|---|---|
| 56,546 | 7/1966 | Foster . |
| 1,705,415 | 3/1929 | Melliger . |
| 2,451,595 | 10/1948 | Wheeler . |
| 3,046,884 | 7/1962 | Pearson . |
| 3,546,779 | 12/1970 | Klein . |
| 3,896,725 | 7/1975 | Grover . |
| 3,988,835 | 11/1976 | Thornton . |
| 4,372,049 | 2/1983 | Hogue . |
| 4,993,159 | 2/1983 | Hull et al. . |

*Primary Examiner*—Harry N. Haroian
*Attorney, Agent, or Firm*—James A. Hinkle

[57] ABSTRACT

A construction layout marker has two marker wheels (1 and 2) positioned in tandem on a wheel frame (3) with a handle frame (6) slanted upwardly from the front marker wheel (1). The two marker wheels are positioned a select distance apart and caused to rotate equally with a rotation equalizer (20–23) to coordinate selective marking with both marker wheels. A pivot marker fork (8) in combination with a wheel position marker (45, 46) provide accurate measurement and marking from a desired starting point. Automatically adjustable roller guides (25–31) at each side provide accurate distancing from edges (24) of surfaces (14) being marked. A brake (32) operated from the handle frame (6) holds the tandem marker wheels in fixed marker relationship for transferring marking indicia to parallel or offset construction surfaces and members. Non-slip surfaces (54) for different types of construction materials are positional on the marker wheels. Ink cartridges with felt marker edges are positional in each wheel. Also positional in each wheel optionally are select weights (55–59) to optimize traction of the marker wheels. Foldability is provided for both the handle frame and the wheel frame.

30 Claims, 4 Drawing Sheets

CONSTRUCTION LAYOUT MARKING DEVICE

BACKGROUND OF THE INVENTION

1. Field of the Invention

The present invention relates generally to the field of markers on wheels for marking surfaces. More particularly, it is a tandem wheel marker for marking horizontal surfaces on building construction members such as beams to indicate positioning of vertical members such as studs and other related construction members.

2. Description of the Prior Art

A marker on a wheel to mark surfaces on which the wheel is rotated is one of the older arts of civilization. There have been a wide variety throughout history. Nearly all have been single wheel types with one or more markers placed on one wheel to mark a surface with each revolution. None have had a tandem wheel construction with an upright handle, a rotation equalizer, a positioning fork, roller guides and other features that make this invention uniquely advantageous for layout marking of buildings under construction. One tandem marker was designed for marking walls aesthetically. But it did not have the measuring, positioning, guiding and handling features of this invention.

Examples of different wheel type devices that have been designed to accomplish various marking objectives include the following U.S. patent documents.

| U.S. Pat. No. | DATE | NAME |
|---|---|---|
| 4,372,049 | Feb. 8, 1983 | Hogue |
| 3,988,835 | Nov. 2, 1976 | Thornton |
| 1,705,415 | Mar. 12, 1929 | Melliger |

The Hogue patent taught a marker wheel with an optional side wheel with a smaller diameter on an offset axle. One wheel rotated on a surface for positioning one type of upright and the other wheel marked positions for other uprights. This device demonstrates side-by-side in contrast to tandem arrangement of marking wheels employed in this invention. The Thornton device had a single marker wheel attached to a handle and an edge guide to hold the wheel next to an edge of a workpiece while rolling the wheel along with the handle to mark the workpiece. Variations of the Thornton device have been most prevalent in the prior art. The Melliger patent taught a wall printer with at least three printing rollers for putting designs on walls to imitate wallpaper. It did not have a measuring fork, a handle frame for positioning marks on horizontal construction members nor other features that would make it suitable for marking construction surfaces. Neither of the single wheel, side-by-side wheel or tandem wheel devices known previously have provided sufficiently accurate measuring capacity to be suitable for construction marking.

SUMMARY OF THE INVENTION

In accordance with the present invention, it is contemplated that this invention provides a construction marker that can:

(a) mark accurately from a given starting point or edge;

(b) transfer measurement marking accurately from one position to another for such construction forms as offset beams;

(c) travel in a straight line without an edge guide;

(d) follow edges accurately with an edge guide that adjusts and resets automatically for edge structures;

(e) be folded easily for carriage and transport;

(f) be adjusted to mark various widths;

(g) mark metal, wood or other construction surfaces equally well;

(h) mark in place or unassembled components and workpieces equally well; and, generally, (i) be used with convenience at low cost to save time and maximize accuracy of marking construction elements.

This invention accomplishes the above and other objectives with a construction layout marker having two marker wheels positioned in tandem on a wheel frame with a handle frame slanted upwardly from a front marker wheel. The two marker wheels are positioned a select distance apart and caused to rotate equally with a rotation equalizer to coordinate selective marking with both marker wheels. A pivot fork in combination with a wheel position marker provide accurate measurement and marking from a desired starting point. Automatically adjustable roller guides at each side provide accurate distancing from edges of surfaces being marked. A brake operated from the handle frame holds the tandem marker wheels in fixed marker relationship for transferring marking indicia to parallel or offset construction surfaces and members. Non-slip surfaces for different types of construction materials are positional on the marker wheels. Ink cartridges with felt marker edges are positional in each wheel. Also positional in each wheel optionally are select weights to optimize traction of the marker wheels. Foldability is provided for both the handle frame and the wheel frame.

Other objects, advantages and capabilities of the invention will become apparent from the following description taken in conjunction with the accompanying drawings showing preferred embodiments of the invention.

DESCRIPTION OF PREFERRED EMBODIMENT

Figure 1:
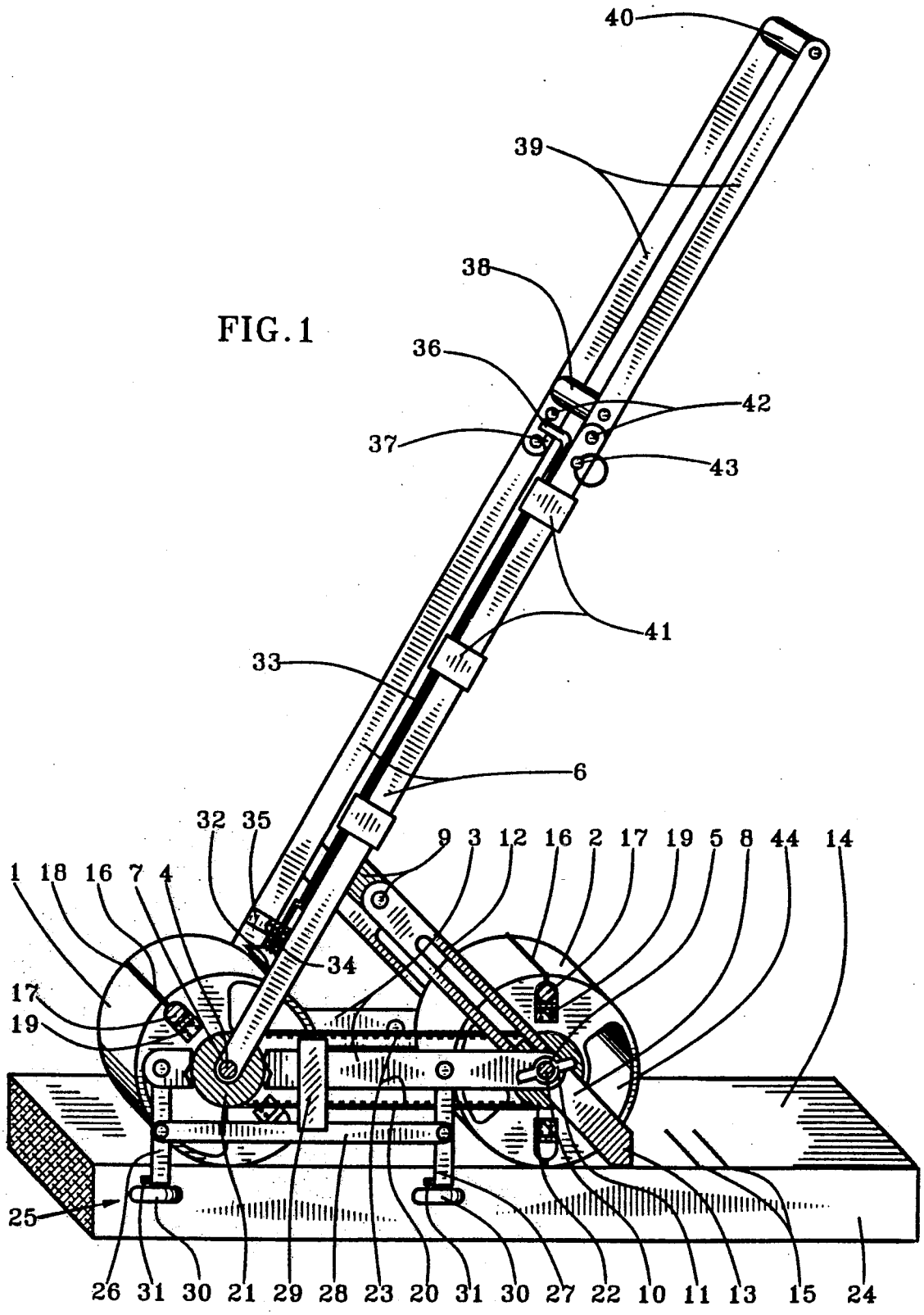
FIG. 1 is a perspective view on a representative surface.

Referring to the drawings wherein like reference numerals designate corresponding parts throughout the several figures, reference is made first to FIG. 1, wherein a front marker wheel 1 and a rear marker wheel 2 are rotatably attached to a wheel frame 3 with front axle 4 and rear axle 5 respectively. A handle frame 6 is attachable with a pivot connection, preferably a handle pivot orifice 7, to the front marker wheel 1. A marker fork 8 is attachable at a proximal end to a fork pivotal attachment 9 to the handle frame 6. The marker fork 8 is attachable to the wheel frame 3 in triangular brace relationship with a marker positioning bolt 10 and a marker positioning nut 11. The marker positioning bolt 10 can be a threaded portion of the rear axle 5 and, therefore, seen to be the same component from a side view. The marker fork positioning nut 11 can be a wing nut. A marker fork slot 12 in the marker fork 8 makes possible a foldable relationship between the wheel frame 3 and the handle frame 6. A distal end of the marker fork 8 is provided with a marker fork tip 13 which is positional at select reference points o a construction surface 14 to be marked.

Construction markings 15 on various construction surfaces 14 will be one or more lines made by a marker element 16 extended from a marker 17 through a marker slot 18 from at least one marker cartridge 19 in at least one marker wheel 1 or 2. When there are two lines as illustrated, they generally will be indicia for positioning sides of various construction elements between them. When only one line is drawn, it can be for positioning of either a center or a particular side of a construction element such as some form of upright. One mark is made by having a marker element 16 extended from only one marking wheel 1 or 2. Two marks are made by having markers extended from both marking wheels 1 and 2, with marker positioning being adjustable by relative circumferential positioning of the marker wheels 1 and 2.

Rotation of the marker wheels 1 and 2 is equalized by a rotation equalizer, preferably in the form of a gear belt 20 in gear drive relationship to a front belt gear 21 and a rear belt gear 22. The front belt gear 21 and the rear belt gear 22 both have the same number and size of gear teeth, such that they are caused to rotate equally by means of engagement with gear belt 20. The belt gears 21 and 22 are fixable rigidly to the respective marker wheels 1 and 2, thereby equalizing rotation of the marker wheels 1 and 2. Either of the marker wheels 1 or 2 can be disengaged from a belt gear 21 or 22 or disengaged from the wheel frame 3 to adjust relative circumferential positioning of the marker wheels 1 and 2. If, for example, only one line were desired, it could be accomplished either by having a marker 17 and marker element 16 in only one wheel 1 or 2, or, alternatively, by having a marker 17 in both marker wheels 1 and 2 in the same circumferential position, such that marks from one marker wheel 1 or 2, would be made on top of the other. If, however, two marks were desired to be one inch apart every circumferential distance of the marker wheels 1 and 2, then a marker slot 18 on a rear marker wheel 2 would be positioned circumferentially by gear belt relationship of gear belt teeth 23 to gears in the respective belt gears 21 and 22 to be one inch of circumferential distance behind the marker slot 18 in the front marker wheel 1. Circumferential distance would be the circumference of the marker wheels 1 and 2, not the belt gears 21 and 22. Such double marks could be farther apart, typically one and one-half inch apart, for most wooden frame housing construction.

Circumferential distance between each separate marking 15 made by one marker wheel, 1 or 2, is determined, of course, by diameter of the marker wheels 1 and 2. Most wood frame construction being standardized at 16 inches between uprights, the diameter of the marker wheels for such construction is the quotient of 16 inches divided by pi (3.14159265), which equals 5.0929582 inches. Different distances apart would require different diameters of marker wheels and 2 to provide construction markings 15 in the same manner. However, some variation is possible with the same diameter of marker wheels 1 and 2 by positioning a marker 17 in a marker slot 18 at one side of one marker wheel, 1 or 2, and at the opposite side of the other. Also, markers 17 could be provided at a plurality of marker cartridge positions on each wheel to provide products and quotients of markings 15 for different increments of measurement.

Guidance along an outside edge 24 of a construction surface 14 is provided by a marking guide, preferably in the form of a roller guide 25. The roller guide 25 is comprised of a front roller guide arm 26 and a rear roller guide arm 27 attached pivotally at their proximal ends to the wheel frame 3. A guide parallel arm 28 is attached pivotally to each guide arm 26 and 27 at equal distances from their proximal end attachment to the wheel frame 3. In addition to keeping the guide arms 26 and 27 parallel, the guide parallel arm 28 also functions as a lock arm with which the guide arms 26 and 27 are held or locked in an up position by a roller guide latch 29 when not in use. A guide roller 30 is attached rotatably to an angled extension 31 on a distal end of each of the guide arms 26 and 27.

The marking guide can also be a simple rod such as roller guide arms 26 and 27 would be without guide rollers 30. A wide variety of marking guides are foreseeable, but the roller guide 25 is preferable.

A brake 32 is attached to a brake rod 33 in slidable attachment to the handle frame 6. The brake 32 is pressurable against the front marker wheel 1 by a brake spring 34 with stored energy employable between a spring bracket 35 and the brake 32. This stored energy causes the brake to resist rotation of marker wheel 1 by frictional contact when the brake 32 is released by disengagement of brake handle 36 from a handle side of a brake open abutment 37 proximate a bottom handle 38. In a preferred construction, the bottom handle 38 and the brake open abutment are on a distal end of a foldable handle extension 39. A top handle 40 is positioned at a proximal end of the foldable handle extension 39. The brake rod 33 is attachable pivotally to a side of the handle frame 6 with brake rod fasteners 41. The foldable handle extension 39 is attachable pivotally to a proximal end of the handle frame 6 with handle axles 42 and lock pins 43.

The marker wheels 1 and 2 can be constructed of light material for light weight of this construction layout marking device. In addition, the marker wheels 1 and 2 can be provided with weight reduction cavities 44.

Figure 2:
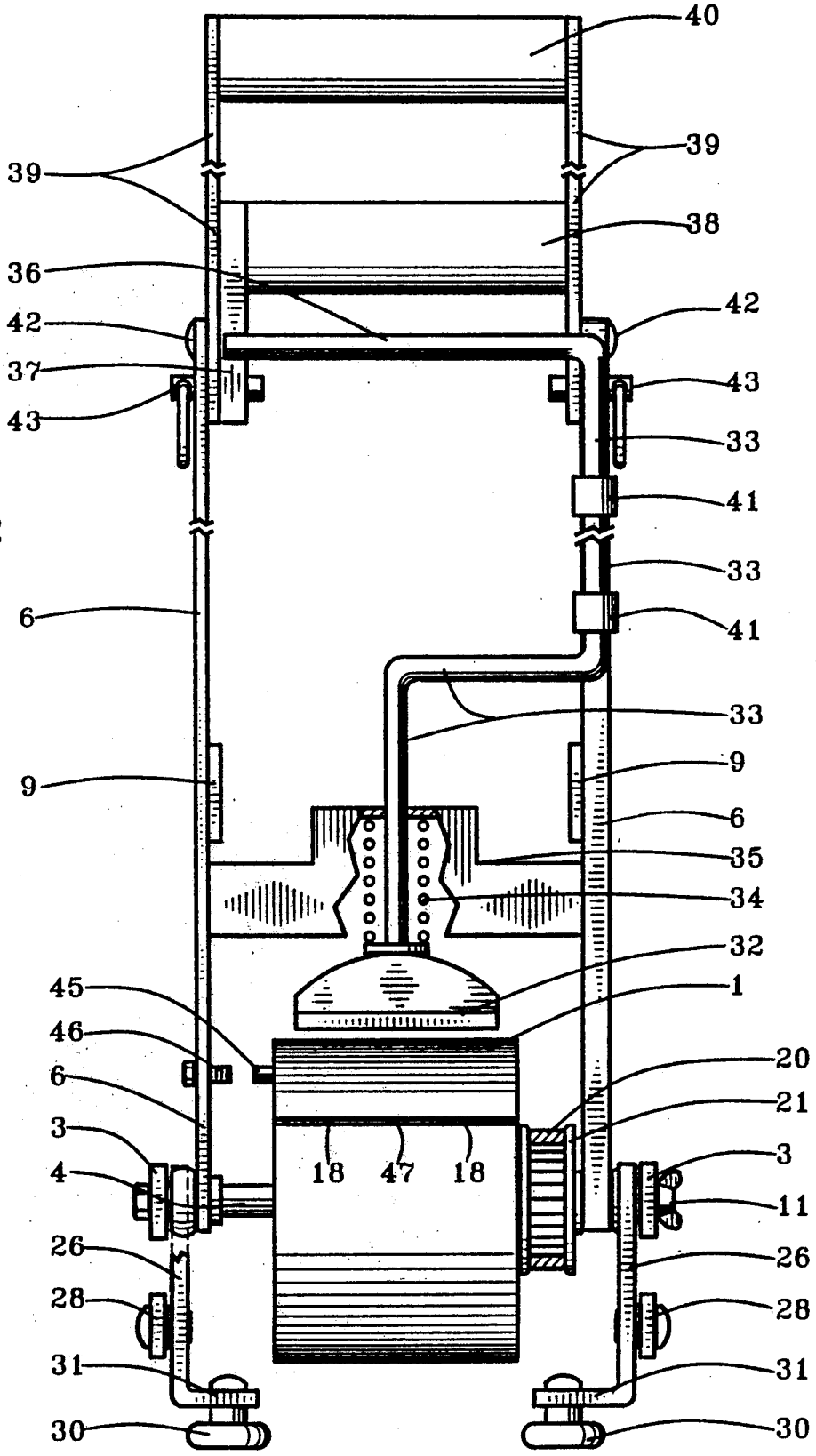
FIG. 2 is a front sectional view.

Referring now to FIG. 2, the handle frame 6 and the foldable handle section 39 are broken in sections to illustrate the working relationships of their components in closer proximity.

From this front sectional view, the front belt gear 21, the front axle 4, the wheel frame 3, roller guide arms 26 at opposite sides of the wheel frame 3, the brake 32, the handle frame 6 and the foldable handle extension 39 all can be seen from a front view in the working relationship described for FIG. 1. In addition, a rotational position marker 45 on a side of front marker wheel 1 and a matching frame marker 46 on the handle frame 6 are provided.

Referring to FIGS. 1 and 2, when the rotational position marker 45 and the frame marker 46 are in line, they can be a reference point of circumferential distance from a starting point to a marking point. For a 16 inch marker, for instance, the distance from the marker fork tip 13 to the bottom of the front marker wheel and the circumferential distance from the bottom of the front marker wheel to the marker slot 18 is 16 inches when the rotational position marker 45 and the frame marker 46 are in line and a single center mark is desired each 16 inches. If a 1.5 inch marker width is desired, then the sum of these distances can be set for 14.5 inches and the marker slot 16 on the rear marker wheel can be adjusted to position a marker element 16 at a distance 1.5 inches further removed from the marker fork tip 13 or vice versa for both.

Also visible from this front view is a wheel center 47. The marker slots 18 are at both sides of the wheel center 47. Marker wheels 1 and 2 are rim-like structures extending axially from each side of the wheel center 47.

Figure 3:
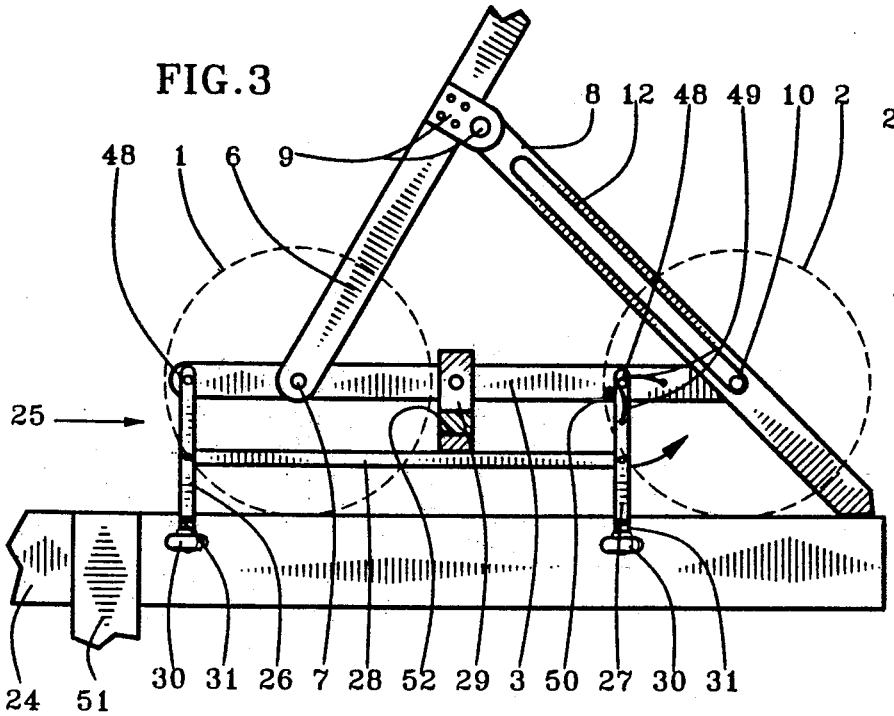
FIG. 3 is an inside sectional view of a side marker and measuring fork in relationship to wheels, a wheel frame and a handle frame.

Reference is made now to FIG. 3 which illustrates an inside view of the roller guide 25. The roller guide arms 26 and 27 are pivotally attached to the wheel frame 3 at guide arm pivot points 48. A marker spring 49 forces the guide arms 26 and 27 downwardly and forwardly in a clockwise direction in this illustration. A marker abutment 50 positioned downward and to the left of the guide arm pivot point 48 nearest the rear marker wheel 2 prevents both roller guide arms 26 and 27 from rotating further downwardly than to a vertical position that is perpendicular to the wheel frame 3. Then when the roller guide 25 encounters a side obstruction 51, the roller guide arms 26 and 27 swing backward counterclockwise in the direction of the arrow shown and return by clockwise pressure of the marker spring 49. When the roller guide arms 26 and 27 are rotated far enough, as when the marking unit is folded for non-use or a roller guide 25 on one side is folded for non-use, the guide parallel arm 28 can rest on a latch platform 52 of the roller guide latch 29.

Figure 4:
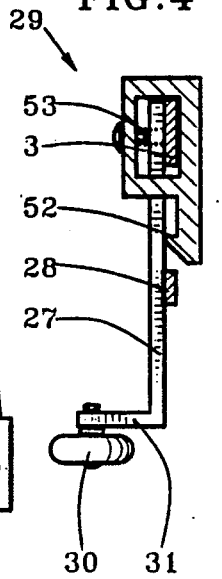
FIG. 4 is a sectional end view of the side marker in FIG. 3.

Referring now to FIG. 4 in conjunction with FIG. 3, roller guide arm 26 or 27 is shown in an extended position, the same as in FIG. 3. However, when parallel arm 28 rests on latch platform 52 in an up position, the guide latch 29 can be pushed manually against a latch spring 53 to cause the latch platform 52 to be moved out from under the guide parallel arm 28 and thus allow the roller guide 25 to spring open to a down position for side guidance.

Figure 5:
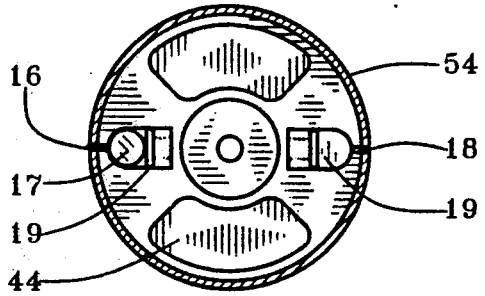
FIG. 5 is a side view of a marker wheel with a marker inserted.
Figure 6:
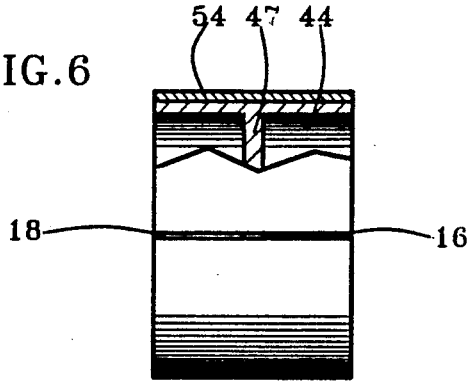
FIG. 6 is a cutaway front view of the FIG. 5 marker wheel.

Referring to FIGS. 5 and 6, a selectively non-slip or non-skid tire 54 can be positioned on an outside circumferential periphery of a marker wheel I or both marker wheels 1 and 2. Diameter of the wheel 1 or 2 should be decreased to compensate for thickness of the non-slip tire. A marker element 16 is extended through a marker slot 18. In FIG. 6, the marker element 16 is extended from only one side of the marker wheel 1.

Figure 7:
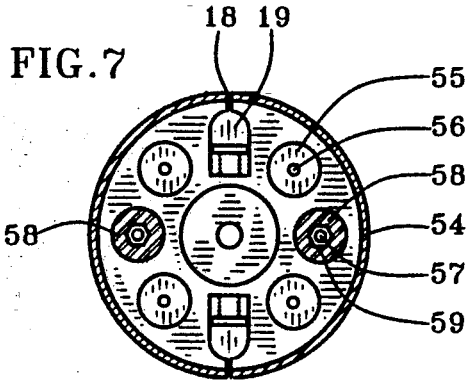
FIG. 7 is a side view of a marker wheel with wheel weight chambers and oppositely positioned wheel weights.
Figure 8:
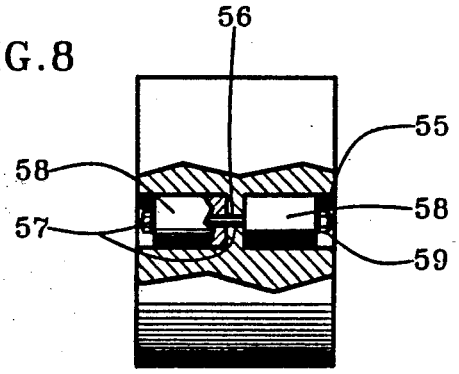
FIG. 8 is a cutaway front view of the FIG. 7 marker wheel.

Referring to FIGS. 7 and 8, wheel weight chambers 55 are provided in place of the weight reduction cavities 44 illustrated in FIGS. 1, 5, 6 and 9. For most use conditions, weight reduction is preferable to weight increase. However, manually pressing down on the unit requires more skill to operate than with the weighted wheels. This is highly significant when unskilled labor or skilled labor with skills in other areas is used. The weighted wheel embodiment is less preferable because skilled labor will be used most often for this type of work and because portability of the unit is highly important.

Each wheel weight chamber is provided with a bolt orifice 56 through which weight attachment bolts 57 are extendable. Wheel weights 58 can be uniformly sized and, therefore, uniformly weighted cylindrical members with an attachment orifice through their centers. An equal amount of wheel weights can be positioned in any two oppositely disposed wheel weight chambers to balance the marker wheels 1 and 2. Standard bolts of equal length can be used as wheel weight bolts 57 and standard fastener nuts can be used as wheel weight fastener nuts 59. This wheel weight embodiment of the invention can be highly practical because of its added versatility over the weight reduction embodiment. It can be made just as light, more accurately due to circular chambers and yet be weighted if desired. Having a plurality of typically six pairs of two wheel weight chambers, the weight of its wheels can be varied widely. The merit of weighted wheels, of course, is that it assures non-slip traction of the wheels for most people while they concentrate on other accuracy factors and still be adaptable for others who prefer light weight and manual pressing down uniformly on the unit while operating it.

Figure 9:
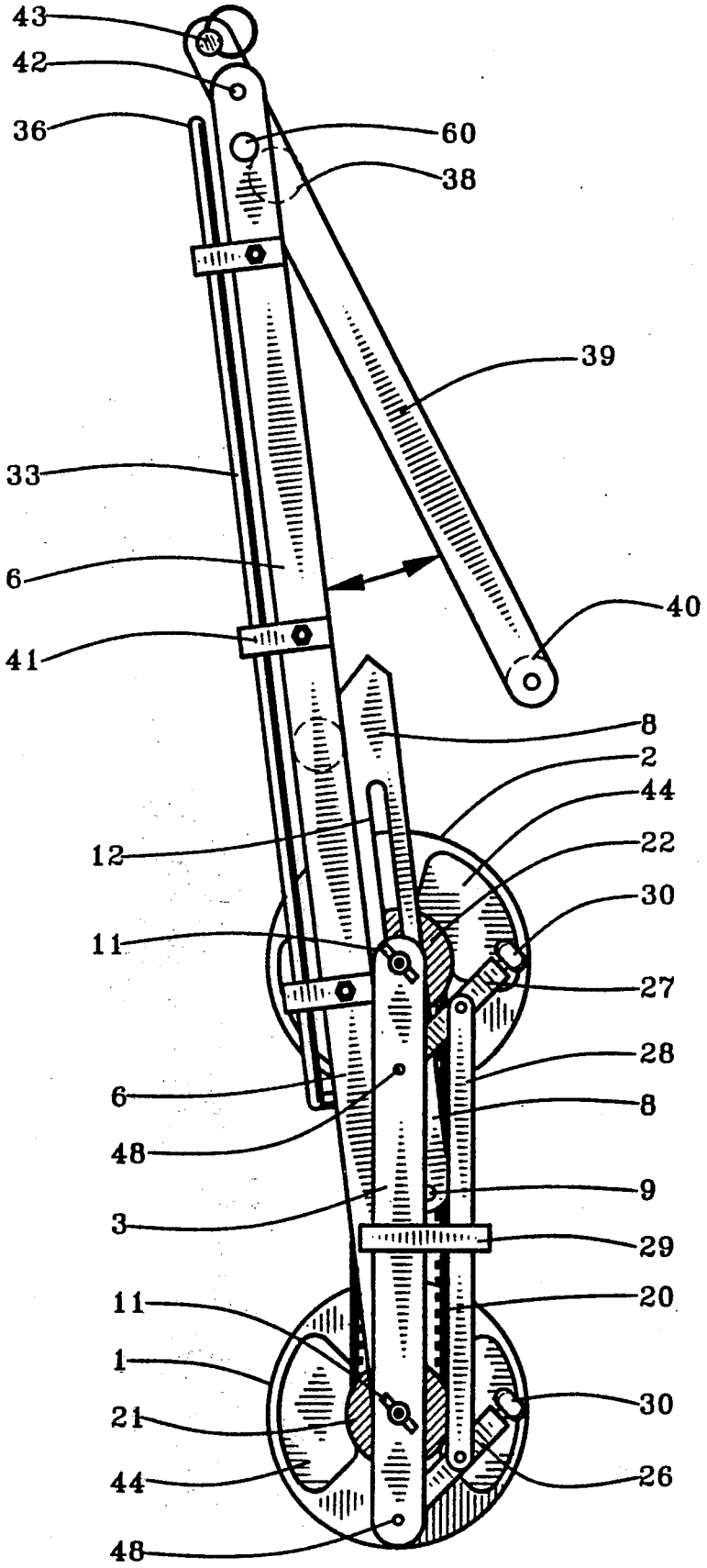
FIG. 9 is a fold-up view from a side.

Referring now to FIG. 9, foldability of this construction layout marking device is achieved by first loosening wing nuts 11. Then the marker fork 8 is brought to a position parallel to and against the handle frame 6. This causes the rear marker wheel 2 to be positioned between sides of the handle frame 6 and causes the wheel frame 3 to be at approximately seven degrees from parallelism with the handle frame 6. The guide parallel arm 28 is locked under the roller guide latch 29, bringing the guide rollers 30 to a position within the circumference of the marker wheels I and 2. Then the lock pins 43 are disengaged from a lock pin orifice 60 and the foldable handle extension 39 is pivoted on handle axles 42 to a position within and parallel to the handle frame 6. The unit is then transportable easily with the bottom handle 38 which becomes a top handle in this inverted condition of the foldable handle extension 39. It is also positional in a tool box designed to enclose and carry it.

A new and useful construction layout marking device having been described, all such modifications, adaptations, substitutions of equivalents, applications and forms thereof as described by the following claims are included in this invention.

Various modifications may be made of the invention without departing from the scope thereof and it is desired, therefore, that only such limitations shall be placed thereon as are imposed by the prior art and which are set forth in the appended claims.

What is claimed is:

1. A construction layout marking device comprising:

a wheel frame having a front marker wheel on a front axle and a rear marker wheel on a rear axle positioned in tandem a select distance behind the front axle, a wheel rotation equalizer in rotation equalizer relationship between the front marker wheel and the rear marker wheel, at least one marker on at least one of the marker wheels, a marker fork extended from the wheel frame a select distance behind the rear axle, and a handle frame extended selectively upwardly and rearwardly from the wheel frame.

2. A construction layout marking device as claimed in claim 1, wherein the wheel rotation equalizer is a gear belt in gear belt drive relationship to a front gear belt wheel attached rigidly to the front marker wheel and a rear gear belt wheel equal in diameter and number of gear teeth to the front gear belt wheel attached rigidly to the rear marker wheel on at least one side of the front marker wheel and on a same side of the rear marker wheel.

3. A construction layout marking device as claimed in claim 1, wherein the handle frame is extended upwardly and rearwardly from a handle frame pivot connection from which the front axle is extended at each side of the wheel frame.

4. A construction layout marking device as claimed in claim 1, wherein the marker fork is pivotally attachable at a proximal end to at least one side of the handle frame and further comprising:

a marker tip on a distal end of the marker fork, a marker slot in a select portion of the marker fork between the marker tip and the proximal end of the marker fork, a marker positioning bolt attached to the wheel frame and extendible through the marker slot, and a marker positioning nut fixable on the marker positioning bolt with the marker fork in triangular brace relationship between the wheel frame and the handle frame.

5. A construction layout marking device as claimed in claim 1, and further comprising:

a brake in rotation arresting relationship to at least one marker wheel operable from a position on the handle frame.

6. A construction layout marking device as claimed in claim 5, wherein the handle frame is extended upwardly and rearwardly from a handle frame pivot orifice through which the front axle is extended at each side of the front axle, the brake is a friction member positional against an outside circumferential periphery of the front marker wheel and further comprising:

a brake spring bracket attachable to the handle frame at a position above the front marker wheel, a brake spring having stored spring energy employable between the brake spring bracket and the brake spring, a brake rod extendable from the brake spring to a brake handle at an opposite side of the brake spring bracket from the brake and in a select position in relationship to a handle on the handle frame, and a brake open abutment at a position on the handle frame in which the brake handle is positional at a proximal side of the brake open abutment to disengage the brake from the front marker wheel in opposition to stored spring energy of the brake spring.

7. A construction layout marking device as claimed in claim 1, and further comprising:

select non-skid friction tires positional on the outside circumferential surfaces of the front marker wheel and rear marker wheel.

8. A construction layout marking device as claimed in claim 1, and further comprising:

a marker cartridge positional in at least one cartridge chamber in at least one of the marker wheels, a marker orifice proximate the at least one cartridge chamber in the at least one marker wheel, and a marker having a marker element extendible through the said marker orifice from the said marker cartridge.

9. A construction layout marking device as claimed in claim 1, and further comprising:

a plurality of marking orifices in the front marker wheel and in the rear marker wheel, a cartridge chamber proximate each marking orifice, and a marking cartridge having a marker with a marker element extendible through the marking orifices from each of select cartridge chambers.

10. A construction layout marking device as claimed in claim 9, wherein the marking orifices are slots parallel to axes of the front marker wheel and the rear marker wheel.

11. A construction layout marking device as claimed in claim 10, wherein the slots are extended from an outside edge to a center wall of the front marker wheel and of the rear marker wheel and further comprising:

a cartridge chamber at each side of the center walls and proximate the slots in the respective marker wheels.

12. A construction layout marking device as claimed in claim 1, and further comprising:

a marking guide extendible perpendicularly downward from at least one side of the wheel frame.

13. A construction layout marking device as claimed in and further comprising:

a roller guide extendible perpendicularly downward from at least one side of the wheel frame.

14. A construction layout marking device as claimed in claim 1, and further comprising:

a roller guide arm having a proximate end swivelably attached to the wheel frame proximate each end of each side of the wheel frame, a guide attached rotatably to an angled extension of a distal end of each roller guide arm, such that axes of guide rollers are approximately perpendicular to the axes of the respective marker wheels, and a guide parallel arm attached swivelably to each roller guide arm at equal distances from a proximal end attachment of each roller guide arm to the wheel frame.

15. A construction layout marking device as claimed in claim 14, and further comprising:

a guide resilient member having stored resilience energy employable between the wheel frame and the roller guide arms in a forward and downward direction of rotation of the angled extension of each roller guide arm.

16. A construction layout marking device as claimed in claim 5, and further comprising:

a roller guide latch in resiliently locking relationship between the wheel frame and the guide parallel arm at each side of the wheel frame, and a roller guide abutment positioned on the wheel frame at a select distance forward and downward from a proximal end attachment of a roller guide arm to each side of the wheel frame.

17. A construction layout marking device as claimed in claim 1, and further comprising:

a brake handle slidably attached to an upward end of the handle frame, a pivotal handle extension of the handle frame attachable to a top end of the handle frame at a position proximate the brake handle, a bottom handle proximate a bottom end of the pivotal handle extension, and a top handle proximate a top end of the pivotal handle extension.

18. A construction layout marking device as claimed in claim 1, and further comprising:

oppositely disposed wheel weight chambers in the front marker wheel and in the rear marker wheel, and select wheel weights positional in the said wheel weight chambers.

19. A construction layout marking device as claimed in claim 1, and further comprising:

a rotational position marker on a side wall of the front marker wheel positioned at a desired circumferential position in relationship to the at least one marker slot in the front marker wheel, and a matching frame marker point in the handle frame.

20. A construction layout marking device comprising:

a wheel frame having a front marker wheel on a front axle and a rear marker wheel on a rear axle positioned in tandem a select distance behind the front axle, a wheel rotation equalizer in rotation equalizer relationship between the front marker wheel and the rear marker wheel, the wheel rotation equalizer being a gear belt in gear belt drive relationship to a front gear belt wheel attached rigidly to the front marker wheel and a rear gear belt wheel equal in diameter and number of gear teeth to the front gear belt wheel attachable rigidly the rear marker wheel on at least one side of the front marker wheel and on a same side of the rear marker wheel, a handle frame extended upwardly and rearwardly from a handle frame pivot connection from which the front axle is extended at each side of the wheel frame, a marker fork pivotally attachable at a proximal end to each side of the handle frame, a marker tip on a distal end of the marker fork at each side of the axle frame, a marker slot in a select portion of the marker fork between the marker tip and the proximal end of the marker fork, a marker positioning bolt attached to the wheel frame and extendible through the marker slot, a marker positioning nut fixable on the marker positioning bolt with the marker fork in triangular brace relationship between the wheel frame and the handle frame, a brake in rotation arresting relationship to the front marker wheel and operable from a position on the handle frame, the brake being a friction member positional against an outside circumferential periphery of the front marker wheel, a brake spring bracket attachable to the handle frame at a position above the front marker wheel, a brake spring having stored spring energy employable between the brake spring bracket and the brake spring, a brake rod extendable from the brake spring to a brake handle at an opposite side of the brake spring bracket from the brake and in a select position in relationship to a handle on the handle frame, a brake open abutment at a position on the handle frame in which the brake handle is positional at a proximal side of the brake open abutment with which the brake is maintainable in disengaged relationship with the front marker wheel in opposition to stored spring energy of the brake spring, a plurality of marking orifices in the front marker wheel and in the rear marker wheel, a cartridge chamber proximate each marking orifice, the marking orifices being slots parallel to axes of respective marker wheels, a rotational position marker on a side wall of the front marker wheel positioned at a desired circumferential position in relationship to the at least one marker slot in the front marker wheel, a matching frame marker point in the handle frame, a roller guide arm having a proximate end swivelably attached to the wheel frame proximate each end of each side of the wheel frame, a guide roller attached rotatably to an angled extension of a distal end of each roller guide arm, such that axes of guide rollers are approximately perpendicular to the axes of the respective marker wheels, a guide parallel arm attached swivelably to each roller guide arm at equal distances from a proximal end attachment of each roller guide arm to the wheel frame, a resilient member having stored resilience energy employable between the wheel frame and the roller guide arms in a forward and downward direction of rotation of the angled extension of each roller guide arm, a roller guide latch in resiliently locking relationship between the wheel frame and the guide parallel arm at each side of the wheel frame, a roller guide abutment positioned on the wheel frame at a select distance forward and downward from a proximal end attachment of a roller guide arm to each side of the wheel frame, a pivotal handle extension of the handle frame attachable to a top end of the handle frame at a position proximate the brake handle, a bottom handle proximate a bottom end of the pivotal handle extension, and a top handle proximate a top end of the pivotal handle extension.

21. A construction layout marking device as claimed in claim 20, and further comprising:

oppositely disposed wheel weight chambers in the front marker wheel and in the rear marker wheel, and select wheel weights positional in the said wheel weight chambers.

22. A construction layout marking device as claimed in claim 20, and further comprising:

select non-skid friction tires positional on the outside circumferential surfaces of the front marker wheel and rear marker wheel.

23. A method for using a construction layout marking device having:

a wheel frame having a front marker wheel on a front axle and a rear marker wheel on a rear axle positioned in tandem a select distance behind the front axle, a wheel rotation equalizer in rotation equalizer relationship between the front marker wheel and the rear marker wheel, the wheel rotation equalizer being a gear belt in gear belt drive relationship to a front gear belt wheel attached rigidly to the front marker wheel and a rear gear belt wheel equal in diameter and number of gear teeth to the front gear belt wheel attached rigidly the rear marker wheel on at least one side of the front marker wheel and a same side of the rear marker wheel, a handle frame extended upwardly and rearwardly from a handle frame pivot connection from which the front axle is extended at each side of the front axle, a marker fork pivotally attachable at a proximal end to each side of the handle frame, a marker tip on a distal end of the marker fork at each side of the axle frame, a rotational position marker on a side wall of the front marker wheel positioned at a desired circumferential position in relationship to the at least one marker slot in the front marker wheel, a matching frame marker point in the handle frame, a marker slot in a select portion of the marker fork between the marker tip and the proximal end of the marker fork, a marker positioning bolt attached to the wheel frame and extendible through the marker slot, a marker positioning nut fixable on the marker positioning bolt with the marker fork in triangular brace relationship between the wheel frame and the handle frame, a brake in rotation arresting relationship to the front marker wheel and operable from a position on the handle frame, the brake being a friction member positional against an outside circumferential periphery of the front marker wheel, a brake spring bracket attachable to the handle frame at a position above the front marker wheel, a brake spring having stored spring energy employable between the brake spring bracket and the brake spring, a brake rod extendable from the brake spring to a brake handle at an opposite side of the brake spring bracket from the brake and in a select position in relationship to a handle on the handle frame, a brake open abutment at a position on the handle frame in which the brake handle is positional at a proximal side of the brake open abutment with which the brake is maintainable in disengaged relationship with the front marker wheel in opposition to stored spring energy of the brake spring, a plurality of marking orifices in the front marker wheel and in the rear marker wheel, a cartridge chamber proximate each marking orifice, a marking cartridge having a marker extended through the marking orifices from each of select cartridge chambers, the marking orifices being slots parallel to axes of respective marker wheels, a roller guide arm having a proximate end swivelably attached to the wheel frame proximate each end of each side of the wheel frame, a guide roller attached rotatably to an angled extension of a distal end of each roller guide arm, such that axes of guide rollers are approximately perpendicular to the axes of the respective marker wheels, a guide parallel arm attached swivelably to each roller guide arm at equal distances from a proximal end attachment of each roller guide arm to the wheel frame, a resilient member having stored resilience energy employable between the wheel frame and the roller guide arms in a forward and downward direction of rotation of the angled extension of each roller guide arm, a roller guide latch in resiliently locking relationship between the wheel frame and the guide parallel arm at each side of the wheel frame, a roller guide abutment positioned on the wheel frame at a select distance forward and downward from a proximal end attachment of a roller guide arm to each side of the wheel frame, a pivotal handle extension of the handle frame attachable to a top end of the handle frame at a position proximate the brake handle, a horizontal handle member proximate a bottom end of the pivotal handle extension, a horizontal handle member proximate a top end of the pivotal handle extension, and said method comprising the following steps:

(a) assuring desired circumferential relationship of a marker on a rear marker wheel to a marker on a front marker wheel by appropriate engagement of gear belt teeth on the gear belt between gear teeth on the gear belt wheel on each marker wheel, (b) positioning the front marker wheel circumferentially with the rotational position marker in line with the wheel frame marker, (c) engaging the brake to prevent rotation of the marker wheels until marking movement is desired, (d) positioning the marker point of the pivot fork at a desired starting point, (e) establishing directional objective and directional guidance contact with a roller guide at a side of the wheel frame in contact with a sidewall of a surface being marked, (f) disengaging the brake, (g) pushing the construction layout marker forward while holding it steadily downward, and (h) maintaining engagement of the roller guide with the side wall of the surface being marked.

24. A method as claimed in claim 23, and further comprising the additional steps of:

(i) engaging the brake, (j) carrying the construction layout marking device to an offset construction surface to be marked, (k) positioning the point of the pivot fork on a point at a right angle from a point from which the point of the pivot fork was removed when carried to the offset construction surface, (l) disengaging the brake, and (m) marking the offset construction surface as a continuation of the original surface previously.

25. A method as claimed in claim 23, wherein the point at which the point of the pivot fork is positioned is a center of a surface to be marked and marking is accomplished from center to ends of the surface to be marked.

26. A method as claimed in claim 23, wherein the point at which the point of the pivot fork is positioned is an edge of a construction wall.

27. A method as claimed in claim 23, wherein the point at which the point of the pivot fork is positioned is a center of a workpiece for use in construction and marking is accomplished from center to ends of the workpiece.

28. A method as claimed in claim 23, wherein the point at which the point of the pivot fork is positioned is an edge of a workpiece for construction.

29. A method as claimed in claim 23, wherein the surface to be marked is dirty, adding a preliminary step of cleaning the surface.

30. A method as claimed in claim 23, wherein marking without manual down pressure on the surface is desired, adding a preliminary step of placing equal wheel weights in oppositely disposed relationship in the front and rear marker wheels.

* * * * *